US011447994B2

(12) United States Patent
Linnenkohl

(10) Patent No.: US 11,447,994 B2
(45) Date of Patent: Sep. 20, 2022

(54) DRIVE DEVICE FOR AN ELEMENT TO BE DRIVEN

(71) Applicant: Gebr. Bode GmbH & Co. KG, Kassel (DE)

(72) Inventor: Lars Linnenkohl, Speele (DE)

(73) Assignee: Gebr. Bode GmbH & Co. KG, Kassel (DE)

( * ) Notice: Subject to any disclaimer, the term of this patent is extended or adjusted under 35 U.S.C. 154(b) by 727 days.

(21) Appl. No.: 16/349,288

(22) PCT Filed: Nov. 11, 2016

(86) PCT No.: PCT/EP2016/077457
§ 371 (c)(1),
(2) Date: May 13, 2019

(87) PCT Pub. No.: WO2018/086705
PCT Pub. Date: May 17, 2018

(65) Prior Publication Data

US 2020/0165853 A1 May 28, 2020

(51) Int. Cl.
*E05D 15/10* (2006.01)
*E05F 15/646* (2015.01)
(Continued)

(52) U.S. Cl.
CPC ..... *E05D 15/1047* (2013.01); *E05F 15/646* (2015.01); *E05F 15/655* (2015.01);
(Continued)

(58) Field of Classification Search
CPC ..... E05D 15/1047; E05D 2015/1026; E05D 2015/1057; E05D 2015/1055;
(Continued)

(56) References Cited

U.S. PATENT DOCUMENTS 5,168,666 A * 12/1992 Koura ..... E05F 15/646 49/360
6,108,976 A * 8/2000 Kato ..... E05F 15/00 49/352
(Continued)

FOREIGN PATENT DOCUMENTS

CN 1818311 8/2006
CN 200952552 9/2007
(Continued)

OTHER PUBLICATIONS

Internationaler Recherchenbericht und der Schriftliche Bescheid [International Search Report and the Written Opinion] dated Jul. 28, 2017 From the Internatioanl Searching Authority Re. Application No. PCT/EP2016/077457 and Its Translation of Search Report Into English. (14 Pages).

*Primary Examiner* — William L Miller

(57) ABSTRACT

The invention relates to a drive device for driving an element, having the following: a toothed belt drive with a toothed belt, a frame element which forms two opposite connection plates and a connection wall that connects the two connection plates together, at least three elongated force driving elements which are secured to the toothed belt and are aligned parallel to the width (B) of the toothed belt and parallel to one another and which are arranged within the frame element, wherein a central force driving element is rotationally fixed to the two connection plates, and the end sections of each adjacent outer force driving element extend through curved elongated holes of the connection plate, whereby the outer force driving element can be pivoted and the end faces of the outer force driving elements have cylindrical projections, which are designed as axle stubs and each of which has a roller, outside of one of the connection plates, a toothed disc with tooth recesses for catching teeth of the toothed belt and force driving element recesses for
(Continued)

catching the force driving elements, a non-linear guide path, at least some sections of which run parallel to the extension of the toothed belt and in which the rollers arranged on the outer force driving elements are guided, and a drive means which is connected to the frame element and is used to connect to the element to be driven.

14 Claims, 5 Drawing Sheets

(51) Int. Cl.
*E05F 15/655* (2015.01)
*E05F 15/681* (2015.01)

(52) U.S. Cl.
CPC .... *E05F 15/681* (2015.01); *E05D 2015/1026* (2013.01); *E05D 2015/1057* (2013.01); *E05Y 2900/531* (2013.01); *Y10T 16/56* (2015.01)

(58) Field of Classification Search
CPC ..... E05F 15/646; E05F 15/655; E05F 15/662; E05F 15/681; E05F 15/643; E05F 15/635; E05F 15/668; E05Y 2900/531; E05Y 2900/506; E05Y 2900/51; B60J 5/06; Y10T 16/27; Y10T 16/56; Y10T 16/364
USPC ..... 16/71, 49, 91; 49/360; 296/155
See application file for complete search history.

(56) References Cited

U.S. PATENT DOCUMENTS 6,321,489 B1 * 11/2001 Murofushi ..... E05F 15/646 49/360
6,464,287 B2 * 10/2002 Rogers, Jr. ..... B60J 5/06 49/360
6,481,783 B1 * 11/2002 Rogers, Jr. ..... B60J 5/06 49/360
7,144,068 B2 * 12/2006 Oxley ..... E05F 15/646 296/155
7,287,805 B2 * 10/2007 Yamada ..... E05F 15/646 49/360
7,325,361 B2 * 2/2008 Rogers, Jr. ..... E05F 15/643 49/360
7,328,934 B2 * 2/2008 Sato ..... E05F 15/646 49/360
7,585,014 B2 * 9/2009 Nishimura ..... B60J 5/06 49/262
8,464,469 B2 * 6/2013 Oberheide ..... E05F 15/646 49/360
8,622,408 B2 * 1/2014 Ishida ..... B60J 5/06 280/163
9,033,397 B2 * 5/2015 Sumiya ..... B60J 5/06 296/155
9,803,407 B2 * 10/2017 Seto ..... B60J 5/047
9,828,796 B2 * 11/2017 Seto ..... B60J 5/062
9,834,970 B2 * 12/2017 Seto ..... E05D 15/1042
10,066,430 B2 * 9/2018 Joussellin ..... B64C 1/1438
2002/0112404 A1 * 8/2002 Au Truong ..... E05F 15/646 49/360
2003/0089042 A1 * 5/2003 Oberheide ..... E05F 15/646 49/352
2004/0177560 A1 * 9/2004 Hoare ..... E05F 15/638 49/360
2004/0216383 A1 * 11/2004 Rogers, Jr. ..... E05F 15/646 49/360
2020/0325960 A1 * 10/2020 Linnenkohl ..... F16G 1/28

FOREIGN PATENT DOCUMENTS

CN 102296904 12/2011
CN 205654793 10/2016
DE 19814670 10/1998
DE 29808567 9/1999
DE 10018332 10/2000
GB 2532176 5/2016
WO WO 2018/086705 5/2018

* cited by examiner

Fig. 9
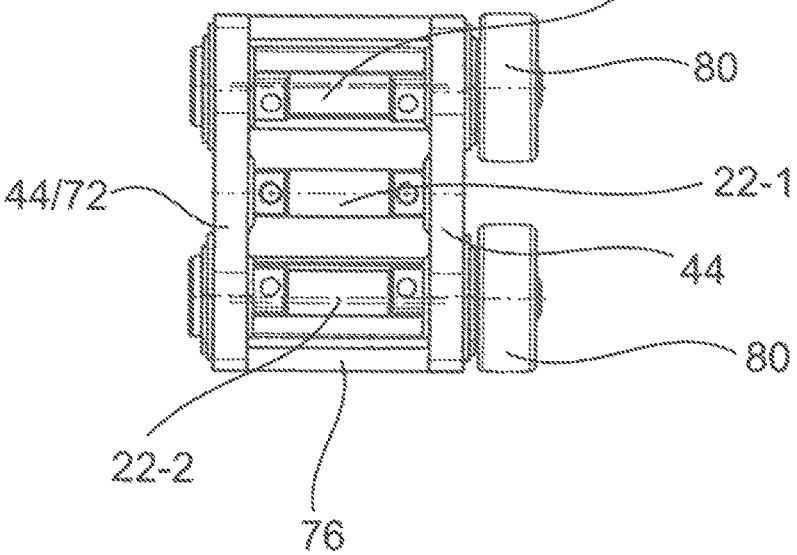
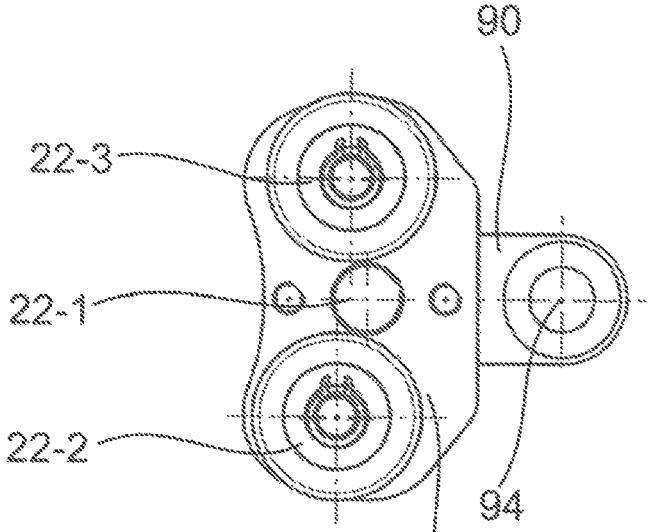
Fig. 10
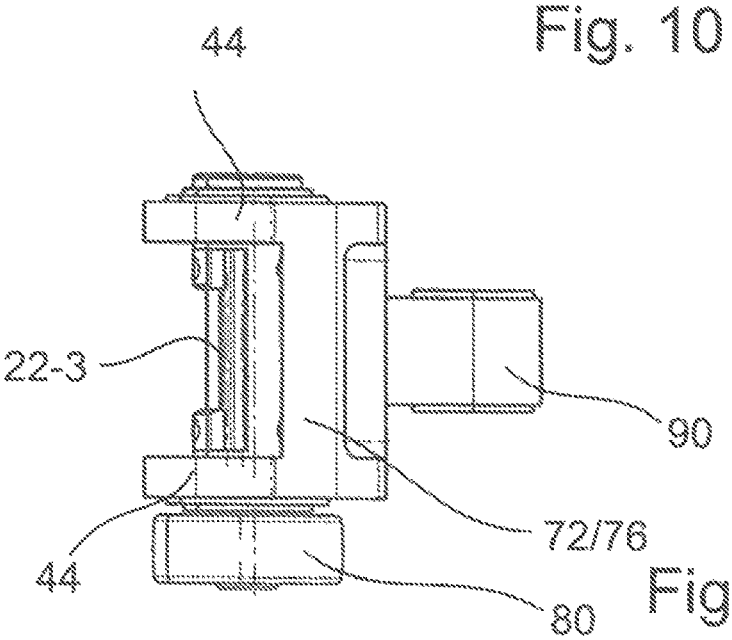
Fig. 11

DRIVE DEVICE FOR AN ELEMENT TO BE DRIVEN

RELATED APPLICATIONS

This application is a National Phase of PCT Patent Application No. PCT/EP2016/077457 having International filing date of Nov. 11, 2016. The contents of the above application is incorporated by reference as if fully set forth herein in its entirety.

FIELD AND BACKGROUND OF THE INVENTION

The present invention pertains to a drive device for driving an element with a toothed belt, a toothed disc and an at least sectionally nonlinear guideway, in which the element is guided with the aid of guide means.

Most toothed belts have a smooth side and a side with teeth. The smooth side is usually located outside whereas the inner side of the toothed belt is provided with teeth. The toothed belt is wrapped around a toothed disc, wherein the teeth of the toothed belt engage into the recesses of the toothed disc such that the toothed disc drives the toothed belt by means of the tooth recesses and the teeth.

Toothed belt drives are frequently used for the transport of objects to be transported or moved horizontally. Toothed belt drives particularly also serve as door drives for opening and closing vehicle doors, particularly doors of local and long-distance public transport vehicles.

In a revolving toothed belt drive, only one of the toothed discs is frequently driven whereas the one or more other two discs merely rotate along and deflect the toothed belt.

The connection of the elements to be moved or transported to the toothed belt is realized, for example, by means of drivers. Problems frequently arise due to the fact that the mounting of the drivers on the toothed belt does not suffice for transmitting high driving forces. The drivers separate due to load peaks or in the course of their operation and therefore necessitate costly repairs.

Toothed belts usually consist of a plastic material that is reinforced by longitudinally extending cables or wires. The cables or wires, which are crucial for absorbing the tensile forces, cannot be damaged when the drivers are attached because the stability and tearing resistance of the toothed belt would otherwise be impaired. This also limits the force transmission to elements to be driven by means of drivers.

Another problem can be seen in that a force transmission only takes place along the longitudinal extent of the toothed belt, i.e. in the x-direction. Although a deflection of the element driven by means of drivers would be possible, e.g. with the aid of guide rails, this is associated with a significant loss of driving energy due to the division of the force application into an x-component (parallel to the moving direction of the toothed belt) and a y-component (transverse to the moving direction of the toothed belt).

This problem arises, e.g., in swinging-sliding doors, which are displaced parallel and sectionally oblique to the outer vehicle wall and guided in a curved guideway. The drive is realized in the form of a toothed belt drive, wherein the door is connected to the toothed belt by means of a driver. Due to the straight extent of the toothed belt, the driving force is only applied in one direction (x-direction), but divided into an x-component and a y-component (transverse to the x-direction) in the course of the movement as a result of the curved guide rail. This division causes considerable losses of driving energy.

Furthermore, a space-saving construction is crucial for many applications. Known drive systems frequently require excessive structural space and also have a relatively elaborate construction.

SUMMARY OF THE INVENTION

The present invention is based on the objective of eliminating the aforementioned disadvantages of the prior art by means of an improved drive device with a toothed belt for driving an element. The drive device particularly should improve the utilization of the driving energy and ensure a permanent and low-maintenance operation of the toothed belt drive. The drive device should have the most compact design possible and particularly also be suitable for space-saving applications.

According to the invention, this objective is attained by means of a drive device with the characteristics of claim 1.

The drive device accordingly comprises:

- a toothed belt drive with a toothed belt,
- a frame element that forms two opposite connection plates and a connection wall, which connects the two connection plates to one another,
- at least three elongate force drivers that are fastened on the toothed belt and aligned parallel to a width B of the toothed belt and parallel to one another,
  - wherein said force drivers are arranged within the frame element, wherein a central force driver is fastened on the two connection plates in a rotationally fixed manner and end sections of the adjacent outer force drivers respectively extend through curved oblong holes of the connection plate such that the outer force drivers can be pivoted, and wherein the ends of the outer force drivers have cylindrical projections, which are realized in the form of axle stubs and respectively carry a roller, outside of one of the connection plates,
- a toothed disc with tooth recesses for catching teeth of the toothed belt and force driver recesses for catching the force drivers,
- a nonlinear guideway, which at least sectionally extends parallel to the extent of the toothed belt and in which the rollers arranged on the outer force drivers are guided, and
- a drive means that is connected to the frame element and serves for the connection to the element to be driven.

The inventive drive device is particularly suitable as a drive for swinging-sliding doors or similar elements such as windows or flaps. In this case, the force originating from the toothed belt drive is also optimally transmitted to the element to be driven if this element is deflected from the straight guideway into a different direction by means of the inventive toothed disc.

The drive device accordingly comprises a toothed disc with tooth recesses for catching teeth of the toothed belt and force driver recesses for catching the force drivers, wherein said toothed disc usually does not perform a driving function, but rather merely deflects the toothed belt. In the context of the invention, however, this toothed disc may also be realized in the form of a driving toothed disc. In this case, the driving force is not only transmitted from the toothed disc to the toothed belt and the element to be driven via the teeth of the toothed belt, but also via the force drivers that are located in corresponding force driver recesses of the toothed disc. In this way, even higher forces can be transmitted if necessary.

If multiple force drivers are simultaneously located in force driver recesses of the toothed disc, the load on the toothed belt is significantly reduced because the forces are distributed over the multiple force drivers. This is also advantageous because the guidance of the force drivers by means of the toothed disc makes it possible to realize a change in direction from the previously exclusive directional component in the x-direction. Changes in direction are frequently associated with dynamic load peaks, which can be absorbed and compensated due to the direct connection between the force drivers and the toothed disc. As in conventional toothed belt drives, the directional deflection by means of the toothed disc may lie between a few degrees and a complete change in direction by 180°.

According to the invention, it suffices if the number of force driver recesses corresponds to the number of force drivers on the toothed belt. If only three force drivers are arranged on the toothed belt, three force driver recesses therefore suffice for accommodating these force drivers. Since the system is a coordinated closed system, the force drivers and the force driver recesses are always located at the same location when they meet. This particularly applies if the toothed belt and therefore the force drivers only travel a short distance, e.g. during an operation in both directions as it is the case with sliding doors.

It furthermore proved particularly advantageous to only drive the toothed discs that do not contact the force drivers during the normal operation. In this way, slipping of the force drivers on the toothed disc is reduced or even prevented.

In a particularly advantageous variation, the force drivers are exclusively fastened on the toothed belt by means of clamping. The clamping connection provides the significant advantage that the structure of the toothed belt is not altered due to the fastening of the force drivers. The cables or wires in the interior of the toothed belt, which are crucial for the tensile strength, particularly remain intact.

In order to produce a clamping connection, the force drivers are preferably divided into an upper part and a lower part, between which the toothed belt is arranged in the fastened state. In this case, the lower part is arranged on the toothed side of the toothed belt and may have an inner side, which faces the toothed belt and corresponds to the teeth of the toothed belt, in order to improve the force transmission in the x-direction. For example, the lower part may have a serrated contour, into which the teeth of the toothed belt engage. This leads to a form-fitting frictional connection between the force driver and the toothed belt.

The connection between the upper part and the lower part may be produced with any suitable means. It proved advantageous if the force driver has a length that exceeds a width of the toothed belt (transverse to its longitudinal extent). The force drivers are arranged transverse to the moving direction or the longitudinal extent of the toothed belt when they are fastened thereon. Drive elements such as screws connect the upper part to the lower part, wherein the screws are arranged laterally of the toothed belt and do not penetrate this toothed belt.

The frame element forms two opposite connection plates and a connection wall that connects the two connection plates to one another. A central force driver is arranged in the frame element and cannot be pivoted or rotated relative to the frame element or the connection plates, respectively. A second force driver and a third force driver are positioned adjacent thereto and can be pivoted due to the oblong holes in the connection plates.

In a particularly advantageous variation, the frame element is realized in one piece. It may be manufactured, for example, in the form of an injection-moulded plastic part.

The connection plates connect the force drivers in such a way that the tensile forces are transmitted between these force drivers by means of the connection plates. The connection plates are provided with the curved oblong holes because a deflection of the toothed belt by means of the toothed disc would otherwise not be possible.

The ends of the two outer force drivers have cylindrical projections, which are realized in the form of axle stubs and respectively carry a roller, outside of one of the connection plates. The rollers move in a non-linear guideway, which at least sectionally extends parallel to the extent of the toothed belt.

A drive means preferably is provided transverse to the longitudinal direction of the toothed belt, i.e. extending perpendicular to the force drivers, wherein said drive means is connected to the frame element and serves for the connection to the element to be driven. The drive means preferably is connected to the connection wall in a rotationally fixed manner. It preferably forms a pivot point for connecting an element driver, which in turn is connected to the element to be driven, e.g. a swinging-sliding door. For this purpose, the drive means may contain a driver opening, which is aligned parallel to the force drivers and in which a driver axis of the element driver is rotatably supported.

The pivotability or rotatability between the drive means and the element to be driven is necessary for guiding the element to be driven along the circumference of the toothed disc when this toothed disc deflects the force drivers. However, the pivotability or rotatability does not necessarily have to be directly ensured by the force drivers or the drive element, but a rigid connection may also be produced at this location as long as the pivotability or rotatability is realized at a different location between the force drivers and the element to be driven.

In a particularly simple preferred variation, the force drivers are realized in the form of essentially cylindrical elements. In this case, the two outer force drivers respectively may carry only a single roller on one side of the toothed belt or two rollers on both sides of the toothed belt.

Additional force drivers, which are connected to one another by means of the connection plate, preferably can be provided in order to additionally improve the force transmission to the element to be driven. If an odd number of force drivers are provided, the connection plates are fastened on the central force driver, wherein the adjacent force drivers extend in corresponding curved oblong holes. Occurring forces are distributed over all connected force drivers by means of the connection plates. For example, groupings of three or five force drivers, which are connected to one another by means of a connection plate, proved particularly suitable. The tension within the toothed belt during its contact with the toothed disc preferably does not increase due to the connection of the force drivers to one another.

In a particularly advantageous variation, the guideway has an arc-shaped section such that the force drivers are moved about the toothed disc in such a way that a beyond-dead-center position is realized. Consequently, the driven element, e.g. a door, can be moved into a closed position, from which it cannot be removed again without a return movement of the toothed belt in the opposite direction. The door is therefore securely locked, e.g. for passengers.

In order to move and subsequently lock a swinging-sliding door, the guideway has a first straight section, a second straight section and an arc-shaped end section, wherein the two straight sections are arranged angular to one another. Consequently, the door can be displaced out of the door portal and subsequently parallel to the outer vehicle wall. When the door is located in the door portal, it is securely locked in the end position by means of the beyond-dead-center lock.

It is preferred to arrange a driven pinion on a free end of the first straight section, a first toothed disc in the region of the transition from the first straight section to the second straight section and a second toothed disc in the region of the arc-shaped end section.

BRIEF DESCRIPTION OF THE SEVERAL VIEWS OF THE DRAWINGS

The invention is described in greater detail below with reference to the following figures. The figures merely show preferred design characteristics and are not intended to limit the invention to these characteristics.

In the figures:

FIG. 9 shows a bottom view of the force driving element according to FIG. 7, FIG. 10 shows a side view of the force driving element according to FIG. 7, and FIG. 11 shows a front view of the force driving element according to FIG. 7.

DESCRIPTION OF SPECIFIC EMBODIMENTS OF THE INVENTION

Figure 1:
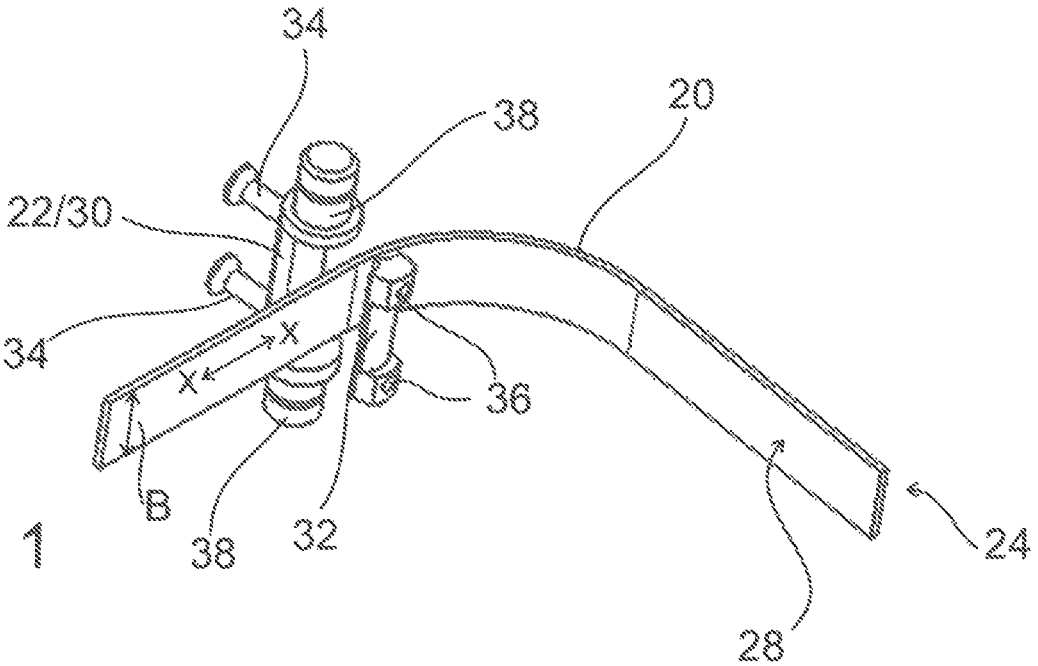
FIG. 1 shows a toothed belt section with an inventive force driver in order to elucidate the fastening principle.

FIG. 1 shows a section of a toothed belt 20, on which an inventive force driver 22 is fastened. The toothed belt has an outer side 24 and an inner side 28 that faces a toothed disc 26 (see FIGS. 3 and 4). The inner side 28 usually has teeth 28 that are not illustrated in the figures.

The force driver 22 is formed by an essentially cylindrical body that is divided into an upper part 30 and a lower part 32. In the exemplary embodiment shown, the upper part 30 and the lower part 32 are connected to one another with connecting means 34, preferably clamping screws, in such a way that the toothed belt 20 is arranged between these two parts. In this case, the lower part 32 is arranged on the inner side 28 and the upper part 30 is arranged on the outer side 24 of the toothed belt. A serrated inner surface of the lower part 32, which faces and corresponds to the teeth of the toothed belt 20, is not illustrated in this figure. The teeth engage into correspondingly shaped depressions in the inner side of the lower part 32 such that a form-fitting frictional connection between the force driver 22 and the toothed belt 20 is produced.

In the exemplary embodiment shown, the lower part 32 has openings 36, into which the connecting means 34 can be inserted, preferably screwed. The connecting means 34, which are illustrated in the form of clamping screws, extend laterally of the toothed belt 20 and do not penetrate this toothed belt. The force driver 20 has a length that correspondingly exceeds the width B of the toothed belt 20.

This figure furthermore shows two drive elements 38, which are realized in the form of axle stubs and laterally protrude over the toothed belt referred to its width B. However, it would also be possible to provide only a single drive element 38 instead of the two laterally protruding drive elements 38. In a manner of speaking, the drive elements 38 represent an extension of the force driver 22 in its longitudinal direction, which in the fastened state respectively extends parallel to the width B of the toothed belt or transverse to a longitudinal extent X-X of the toothed belt. According to the invention, the axle stubs or the projections respectively carry a roller 80 (see FIGS. 7-11).

Figure 2:
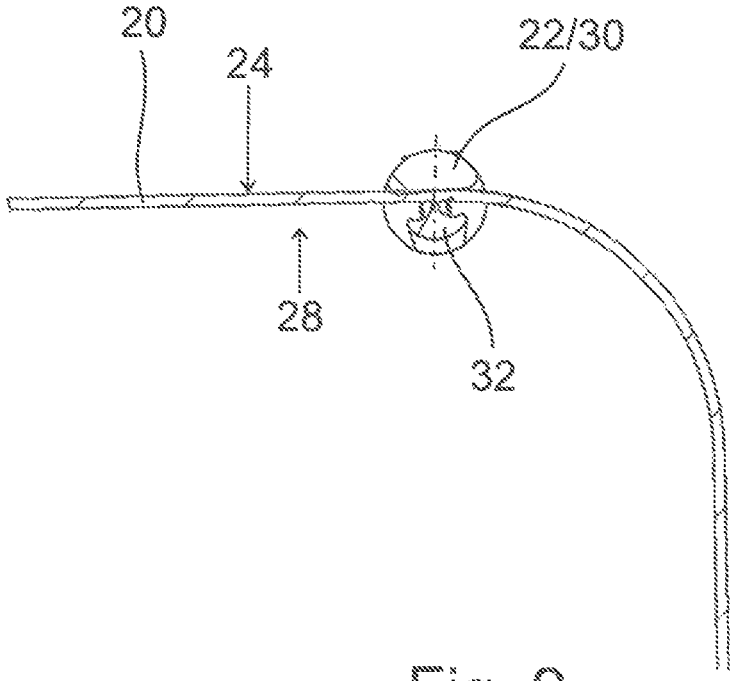
FIG. 2 shows a sectional view of a toothed belt section with a force driver fastened thereon.

FIG. 2 shows the arrangement of a force driver 22 on the toothed belt 20 in the form of a sectional view.

Figure 3:
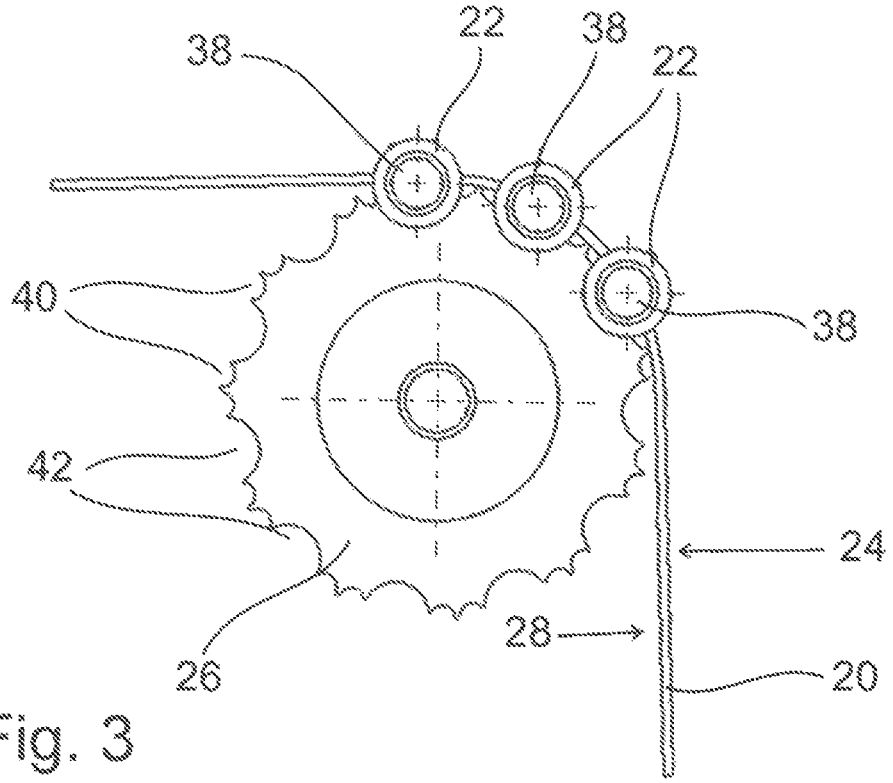
FIG. 3 shows a side view of an inventive toothed disc with a toothed belt section and three force drivers.

FIG. 3 shows three adjacent force drivers 22 that are arranged on the toothed belt 20. This figure furthermore shows that the toothed disc 26 has on the one hand tooth recesses 40 for receiving and catching the teeth of the toothed belt 20 and on the other hand force driver recesses 42 for receiving and catching the force drivers 22. When the toothed disc 26 drives the toothed belt and the force drivers 22 are located in the force driver recesses 42, the driving force of the toothed disc 26 is directly transmitted to these force drivers.

Figure 4:
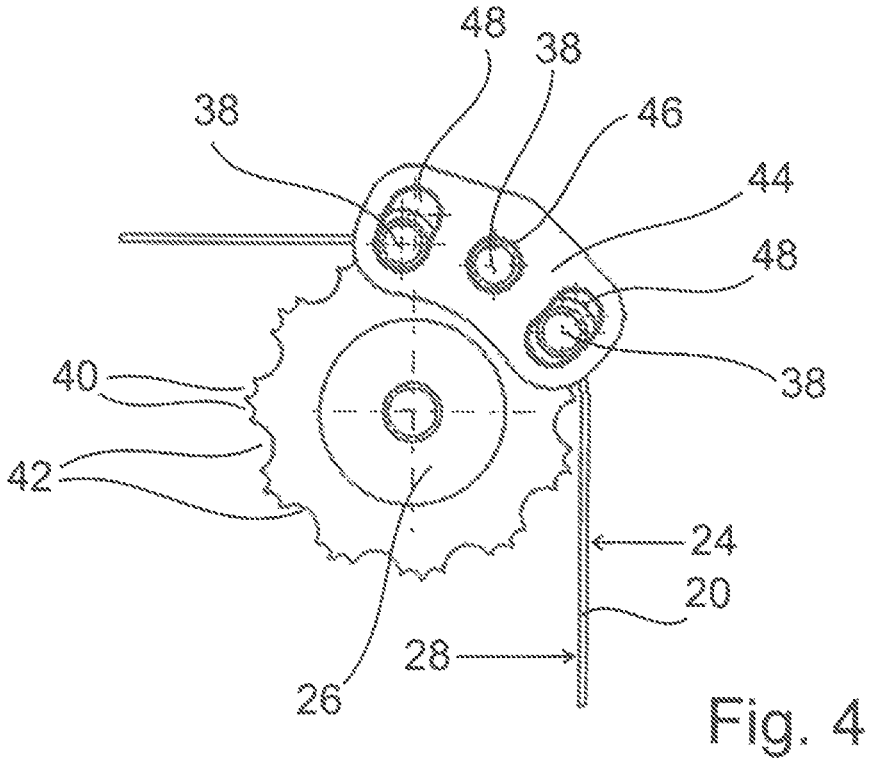
FIG. 4 shows a side view according to FIG. 3 with an additional connection plate.

FIG. 4 shows a simplified illustration that elucidates the function of an inventive connection plate 44. The connection plate 44 shown connects the three force drivers 22 to one another in the pulling direction of the toothed belt 20. The central force driver 22 is non-rotatably supported in this case.

The connection plate 44 furthermore contains two curved oblong holes 48, into which respectively cylindrical projections of the outer force drivers 22 extend. The rollers 80 arranged on these projections are not illustrated in this figure. The curved oblong holes 48 allow a pivoting motion of the connection plate 44 during the change in direction by means of the toothed disc 26. The connection plate 44 simultaneously ensures that forces are distributed over the three force drivers 22 and that the tension of the toothed belt 20 remains unchanged.

Figure 5:
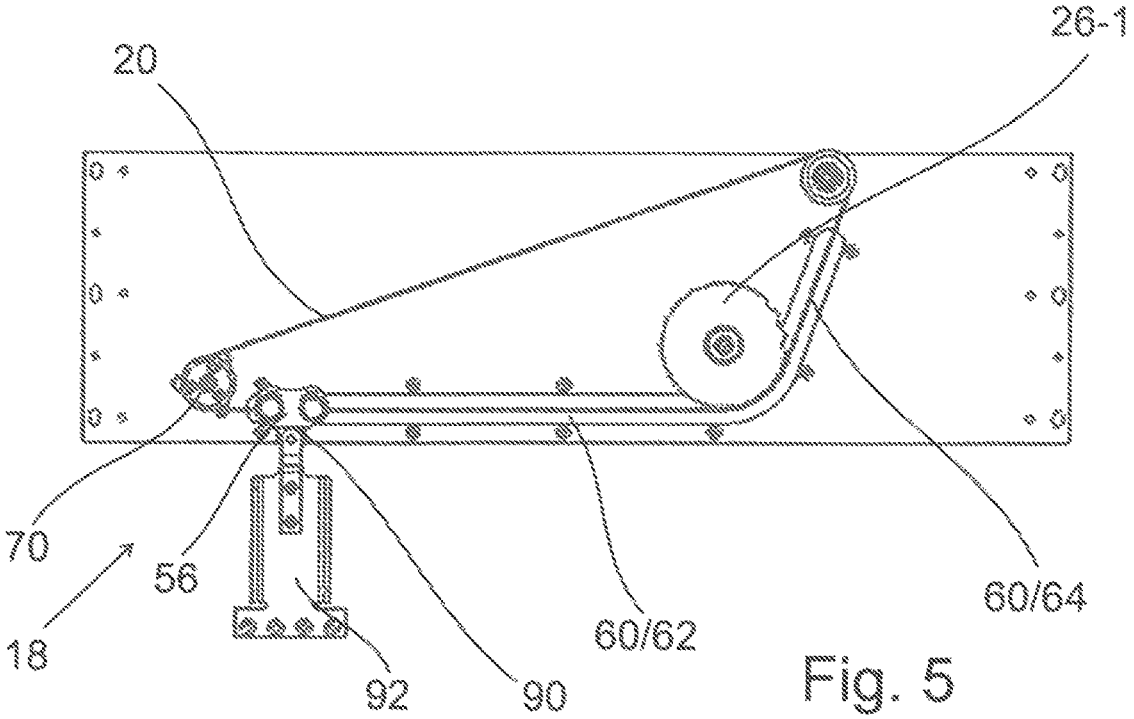
FIG. 5 shows an inventive drive device with a guideway and a door in the open position.

FIG. 5 shows a preferred variation of an inventive drive device 18 in the form of a simplified schematic illustration. This figure shows an element driver 92 that is pivotably supported on a drive means 90 of the force driving element 56. The element driver 92 serves for the connection to the element to be driven, e.g. a not-shown door 50. The force driving element 56 is connected to the toothed belt 20. Not-shown rollers 80 arranged on the ends of the force drivers 22 are guided in a guideway 60. The guideway 60 has a first straight section 62 and a second straight section 64. A preferably electric driving motor 68 (see FIG. 6) drives the toothed belt 20 by means of a pinion 70. A first toothed disc 26-1 is arranged in the region of the transition from the first section 62 to the second section 64. The door 50 is in its open position.

FIG. 5 also shows that only three force driver recesses 42 are provided for catching the force drivers 22. Since the force drivers 22 always travel exactly the same distance, the first toothed disc 26-1 also can be exactly adapted to the position of the force drivers 22, wherein only a one-time preadjustment of the device is required. This figure furthermore shows that only the pinion 70 is driven, but not the first toothed disc 26-1. In this way, slipping of the force drivers 22 on the first toothed disc 26-1 is effectively prevented.

Figure 6:
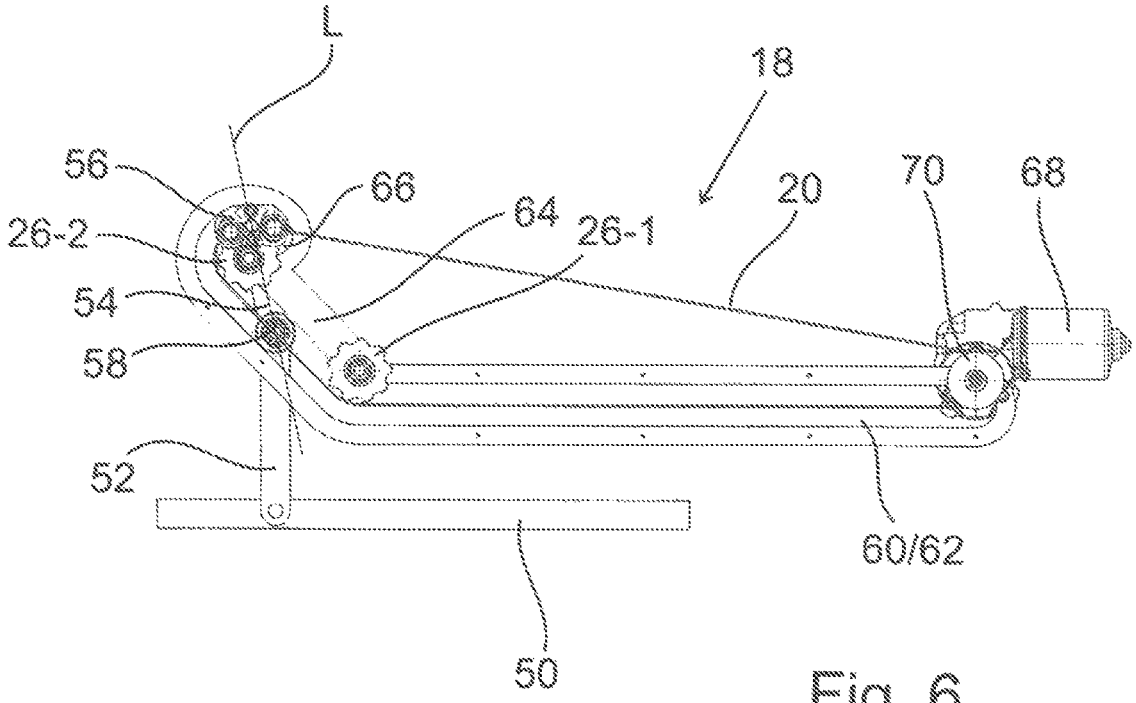
FIG. 6 shows the drive device according to FIG. 5 with the door in the closed position.
Figure 7:
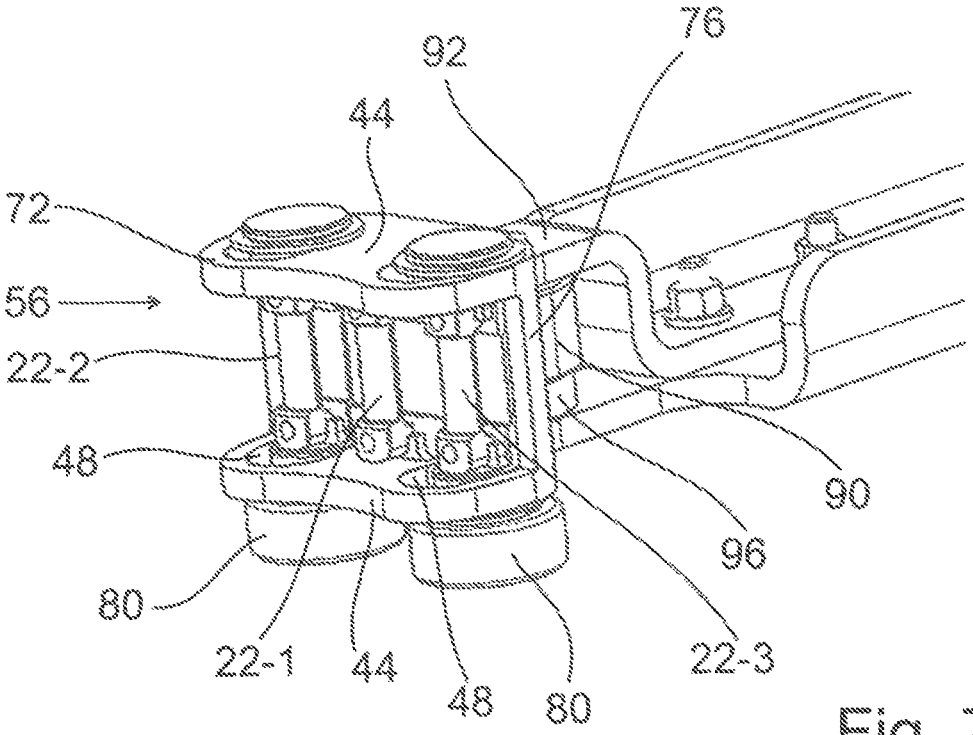
FIG. 7 shows an enlarged perspective view of a force driving element with driver element.
Figure 8:
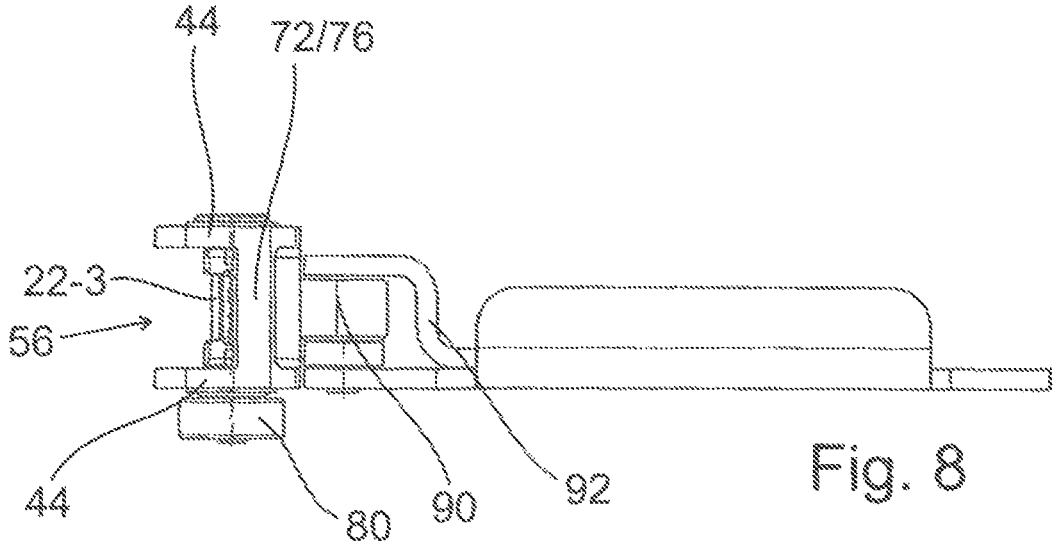
FIG. 8 shows a side view of the force driving element according to FIG. 7.

FIG. 6 shows a variation with a beyond-dead-center position. A second toothed disc 26-2 is arranged in the region of the arc-shaped end section 66. In this variation, the force driving element 56 is moved from the first section 62 up to the arc-shaped end section 66, but does not pass the pinion 70. This pinion insofar also has no force driver recesses 42, but only tooth recesses 40. A beyond-dead-center position is reached in this closed position. This is indicated by the line L.

FIGS. 7-11 show the structure of the force driving element 56. A central force driver 22-1, which cannot be pivoted or rotated, is arranged in a frame element 72. A second force driver 22-2 and a third force driver 22-3 are arranged adjacent thereto and can be pivoted due to the oblong holes 48 such that the force driving element 56 can move about the toothed discs 26. The frame element 72 basically forms two opposite connection plates 44 and a connection wall 76, which connects the two connection plates to one another. The outer force drivers 22 extend through the oblong holes 48 and carry rollers 80.

A drive means 90 preferably is provided transverse to the longitudinal direction of the toothed belt 20, i.e. extending perpendicular to the force drivers 22, wherein said drive means is connected to the frame element 72 and serves for the connection to the element driver 92 to be driven. The drive means 90 preferably is connected to the connection wall 76 in a rotationally fixed manner. It preferably forms a pivot point for connecting an element driver 92, which in turn is connected to the element to be driven, e.g. a door 50. For this purpose, the drive means may contain a driver opening 94, which is aligned parallel to the force drivers 22 and in which a driver axis 96 of the element driver 92 is rotatably supported.

The invention is not limited to the described exemplary embodiments, but rather also includes other variations that are covered by the claims. Instead of providing three force drivers 22, it would particularly also be possible to provide more force drivers 22. An arrangement of connection plates 44 on both sides of the force drivers 22 would also be conceivable.

What is claimed is:

1. A drive device (18) for driving an element, comprising a toothed belt drive with a toothed belt (20), a frame element (72) that forms two opposite connection plates (44) and a connection wall (76), which connects the two connection plates (44) to one another, at least three elongate force drivers (22) that are fastened on the toothed belt (20) and aligned parallel to a width B of the toothed belt (20) and parallel to one another, wherein said force drivers are arranged within the frame element (72), wherein a central force driver (22-1) is fastened on the two connection plates (44) in a rotationally fixed manner and end sections of the adjacent outer force drivers (22) respectively extend through curved oblong holes (48) of the connection plate (44) such that the outer force drivers (22-2, 22-3) can be pivoted, and wherein the ends of the outer force drivers (22-2, 22-3) have cylindrical projections, which are in the form of axle stubs and respectively carry a roller (80), outside of one of the connection plates (44), a toothed disc (26) with tooth recesses (40) for catching teeth of the toothed belt (20) and force driver recesses (42) for catching the force drivers (22), a nonlinear guideway (60), which at least sectionally extends parallel to the extent of the toothed belt (20) and in which the rollers (80) arranged on the outer force drivers (22-2, 22-3) are guided, and a drive means (90) that is connected to the frame (72) element and serves for the connection to the element to be driven.

2. The drive device (18) according to claim 1, wherein the drive means (90) is connected to the connection wall (76) in a rotationally fixed manner.

3. The drive device (18) according to claim 2, wherein the drive means (90) forms a pivot point for connecting an element driver (92).

4. The drive device (18) according to claim 3, wherein the drive means (90) contains a driver opening (94), which is aligned parallel to the force drivers (22) and in which a driver axis (96) of the element driver (92) is rotatably supported.

5. The drive device (18) according to claim 1, wherein the guideway (60) has an arc-shaped section (66) such that the force drivers (22) are moved about the toothed disc (26).

6. The drive device (18) according to claim 1, wherein the toothed disc (26) is in the form of a driven pinion.

7. The drive device (18) according to claim 6, wherein the driven pinion having tooth recesses (40) for catching teeth of the toothed belt (20).

8. The drive device (18) according to claim 1, wherein the guideway (60) has a first straight section (62), a second straight section (64) and an arc-shaped end section (66), wherein the two straight sections (62, 64) are arranged angular to one another.

9. The drive device (18) according to claim 8, wherein a driven pinion is arranged on a free end of the first straight section (62);

wherein the toothed disc (26) is arranged in the region of the transition from the first straight section (62) to the second straight section (64);

wherein the drive device (18) further comprises an additional toothed disc (26-2) arranged in a region of the arc-shaped end section (66);

wherein the force drivers (22) are moved about the additional toothed disc (26-2).

10. The drive device (18) according to claim 1, wherein the driven element is a door (50).

11. The drive device (18) according to claim 1, wherein the force drivers (22) are connected to the toothed belt (20) by means of a clamping connection.

12. The drive device (18) according to claim 11, wherein the force drivers (22) consist of two parts, namely a lower part (32) that in a fastened state is arranged on an inner side (28) of the toothed belt (20) and an upper part (30) that is arranged on an outer side (24) of the toothed belt (20), wherein said lower part and upper part can be connected to one another in such a way that they clamp the toothed belt (20) between one another.

13. The drive device (18) according to claim 12, wherein the upper part (30) and the lower part (32) are screwed to one another in the fastened state.

14. The drive device (18) according to claim 1, wherein the force drivers (22) have a length L, which in a fastened state extends parallel to the width B of the toothed belt (20) and exceeds the width B of the toothed belt (20), wherein a lower part (32) and an upper part (30) are connected to one another with the aid of connecting means (34) that extend laterally adjacent to the toothed belt (20).

* * * * *